United States Patent [19]

Iio

[11] 4,353,333

[45] Oct. 12, 1982

[54] TWO CYCLE ENGINE WITH AUGMENTED INTAKE PORTS

[75] Inventor: Toshimitsu Iio, Hamamatsu, Japan

[73] Assignee: Yamaha Hatsudoki Kabushiki Kaisha, Iwata, Japan

[21] Appl. No.: 164,850

[22] Filed: Jun. 30, 1980

[30] Foreign Application Priority Data

Jul. 3, 1979 [JP] Japan ..... 54-84075

[51] Int. Cl.[3] ..... F02B 33/04

[52] U.S. Cl. ..... 123/73 R; 123/73 PP; 123/73 A; 123/74 R

[58] Field of Search ..... 123/73 R, 73 A, 73 PP, 123/74 R

[56] References Cited

U.S. PATENT DOCUMENTS 2,816,529 12/1957 Flatz et al. ..... 123/73 A X
3,905,341 9/1975 Boyesen ..... 123/73 R
4,121,552 12/1978 Mithuo et al. ..... 123/73 R X
4,178,886 12/1979 Uchinishi ..... 123/73 A
4,235,206 11/1980 Boyesen ..... 123/73 A X

FOREIGN PATENT DOCUMENTS 47-29841 9/1972 Japan ..... 123/73 R

*Primary Examiner*—Wendell E. Burns
*Attorney, Agent, or Firm*—Donald D. Mon

[57] ABSTRACT

A two cycle engine has a cylinder, a piston axially slidably mounted in said cylinder, and through the wall of the cylinder an intake port, exhaust port, and scavenging port. These ports are respectively connected to intake, exhaust, and scavenging passages. An auxiliary intake passage opens through the cylinder wall, circumferentially spaced from the other intake passage so as to leave an axially-extending side-support surface to permit of an enlarged total intake port area without permitting the piston to tilt or otherwise wander from its true path, thereby to reduce piston clatter and wear, and to improve engine performance.

4 Claims, 5 Drawing Figures

TWO CYCLE ENGINE WITH AUGMENTED INTAKE PORTS

FIELD OF THE INVENTION

The present invention relates to improvements in a two-cycle engine formed with intake, scavenging and exhaust passages which open into the piston sliding wall of a cylinder.

BACKGROUND OF THE INVENTION

It is well known in the art that, if the intake port (the opening of an intake passage) of a two-cycle engine is enlarged, the intake efficiency can be increased to improve the engine performance. However, an inherent limit exists in the area of the piston sliding wall of the cylinder. The intake, scavenging and exhaust ports are opened and closed by the piston so that the opening and closing timings (i.e., port timings) are dependent upon the area, shape and position relationships of those ports and therefore these exert heavy influences upon the engine performance. Therefore, it is difficult to enlarge the intake port to an arbitrary extent. Especially in order to enlarge the intake port while properly maintaining the port timings, the intake port has to be enlarged in the circumferential direction of the piston sliding wall of the cylinder. In this situation, the area of the sliding wall receiving the piston is accordingly reduced. As a result, the piston, which is liable to be forced into contact with the intake port when it is shifted to its rising stroke from the bottom dead center, will be tilted, generally speaking, with the resultant drawbacks that the piston has its skirt portion abutting against the edge portion of the intake port thereby to generate rattling noises, and that the sliding resistance is increased thereby to increase the power loss. Therefore, such means has not been employed.

BRIEF DESCRIPTION OF THE INVENTION

The present invention resides in the enlargement of the effective area of the intake port, while eliminating the drawbacks concomitant with the prior art, thereby to improve the engine performance.

This invention is carried out in a two cycle engine having a cylinder with a piston sliding wall. A piston reciprocates in the cylinder in known manner. Intake, exhaust, and scavenging ports open into the cylinder wall, and are appropriately shaped and sized so the piston acts as a timing means to open and close them at appropriate times. A feature of this invention resides in providing one or more auxiliary intake ports, circumferentially (angularly) spaced from the main intake port, whereby to form an axial guide surface to reduce or to prevent tilting of the piston as it slides past the intake ports.

The above and other features of this invention will be fully understood from the following detailed description and the accompanying drawings, in which:

DETAILED DESCRIPTION OF THE INVENTION

Figure 1:
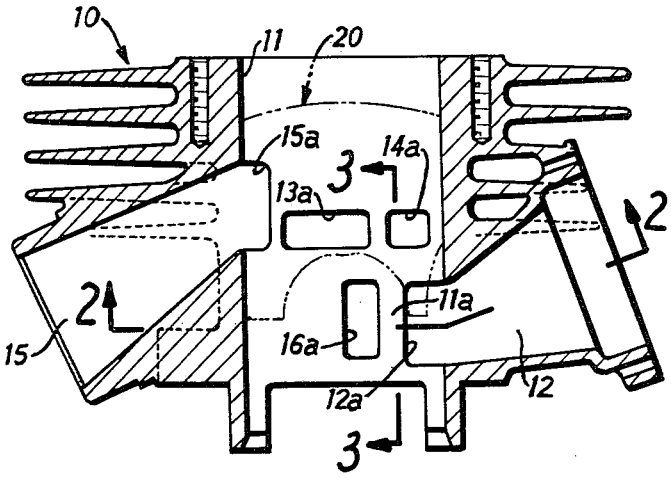
FIG. 1 is a longitudinal section showing a portion of a two-cycle engine according to one embodiment of the present invention.
Figure 3:
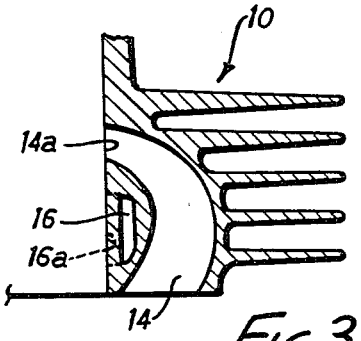
FIG. 3 is a section taken along line III—III in FIG. 1.
Figure 2:
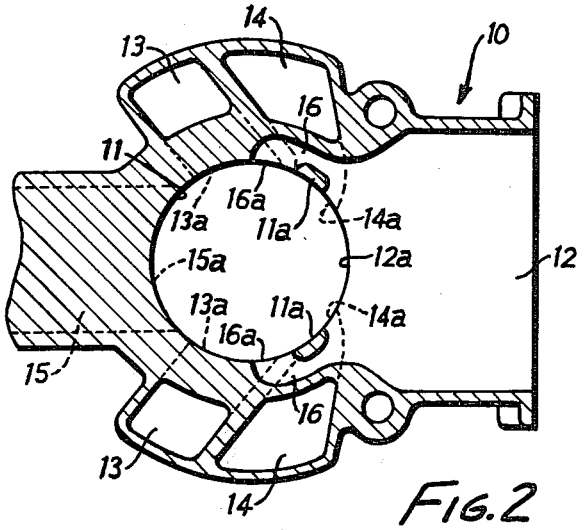
FIG. 2 is a section taken along line II—II in FIG. 1.

FIG. 1 shows a portion of the cylinder of a two-cycle engine according to one embodiment of the present invention. The cylinder 10 is cast of aluminum and has its bore plated with chromium to provide a piston sliding wall 11. Moreover, the cylinder 10 is formed, as shown in FIGS. 1 to 3, with a main intake passage 12 having communication with a carburetor, main and auxiliary scavenging passages 13 and 14 having communications with the crank chamber of the engine, and an exhaust passage 15 having communication with an exhaust pipe. These respective passages 12 to 15 are opened into the piston sliding wall 11 to provide a main intake port 12*a*, a main scavenging port 13*a*, and auxiliary scavenging port 14*a*, and an exhaust port 15*a*. These respective ports 12*a* to 15*a* are repeatedly opened and closed by the sliding movements of the piston 20, which is fitted in the bore of the cylinder 10, so that the suction, compression, explosion and exhaust strokes are completed within the cylinder 10 while the piston 20 accomplishes its two strokes.

The cylinder 10 is formed with two auxiliary intake passages 16. Each of these auxiliary intake passages 16 is constructed to fit between the piston sliding wall 11 and the auxiliary scavenging passage 14. One end communicates with main intake passage 12 and its other end opens into the piston sliding wall in circumferential alignment with main intake port 12*a* at an elevation below the main scavenging port 13*a*, thereby to provide an auxiliary intake port 16*a*. As a result, this auxiliary intake port 16*a* is positioned at a preset circumferential spacing from the main intake port 12*a*, and the piston sliding wall 11 has a guide surface 11*a* disposed between the respective intake ports 12*a* and 16*a*.

Because the two auxiliary intake ports 16*a* are provided, the total effective area of intake port is increased by their effective areas, and the engine performance can be improved. In addition, since the piston sliding wall 11 has guide surfaces 11*a* between main intake port 12*a* and auxiliary intake ports 16*a*, the piston 20 is guided by the piston sliding wall 11 so that it is restrained from tilting when it is shifted into its rising stroke from the bottom dead center. Therefore, even though the total effective area of intake port is increased, thereby to improve the engine performance, the engine can be free from the drawbacks of generation of rattling noises or the loss in the output power due to the tilting phenomena of piston 20.

Figure 4:
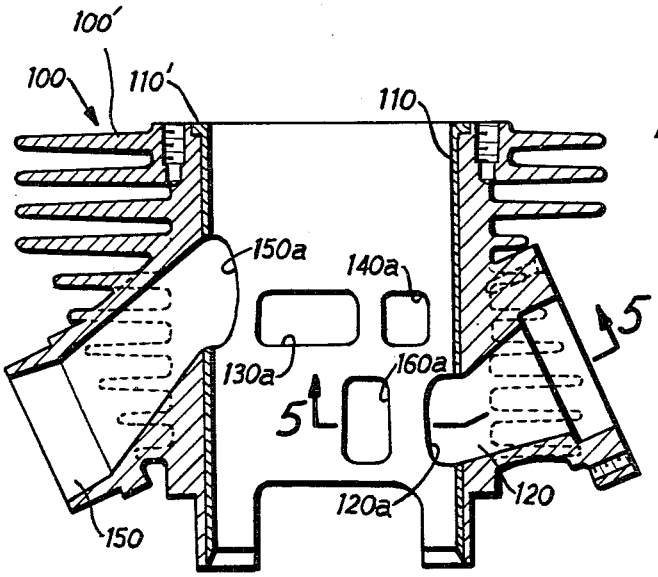
FIG. 4 is a longitudinal section showing a portion of a two-cycle engine according to another embodiment of the present invention.
Figure 5:
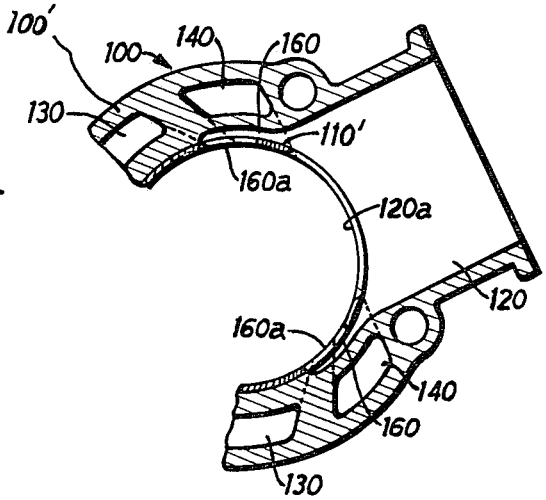
FIG. 5 is a section taken along line V—V in FIG. 4.

Turning to FIGS. 4 and 5, there is shown a second embodiment of the present invention. This engine has its cylinder 100 constructed to include a cylinder body 100' and a sleeve 110'. Cylinder body 100' is formed similarly to the first embodiment, with a main intake passage 120, a main scavenging passage 130, an auxiliary scavenging passage 140, and an exhaust passage 150. On the other hand, sleeve 110' is made of cast iron and is press-fitted in the bore of cylinder body 100' so that the inner circumference of sleeve 110' provides a piston sliding wall 110. Moreover, sleeve 110' is formed with openings which correspond to those of main scavenging passage 130, auxiliary scavenging passage 140 and exhaust passage 150 of the bore of cylinder body 100', thus providing a main scavenging port 130*a*, an auxiliary scavenging port 140*a* and an exhaust 150*a*.

The opening of intake passage 120 in the bore of cylinder body 100' extends to below the opening of main scavenging passage 130 in said bore. On the other hand, sleeve 110' is formed with a larger opening, which is positioned to correspond to the aforementioned opening of intake passage 120, and with two smaller openings which are juxtaposed to each other at a preset spacing apart while interposing the larger opening between them. As a result, when sleeve 110' is press-fitted into the bore of the cylinder body 100', the larger opening provides main intake port 120*a*, whereas the smaller openings provide two auxiliary intake ports 160*a*. Intake passage 120 outside of sleeve 110' partially forms auxiliary intake passages 160. Again, the auxiliary intake ports are circumferentially spaced from the main intake port, and leave axially-extending guide surfaces between them.

The operations and resultant effects of the second embodiments are similar to those of the first embodiment, and their detailed description will therefore be omitted here.

As is apparent from the foregoing description, the present invention resides in a two-cycle engine including intake, scavenging and exhaust passages opened into the piston sliding wall of a cylinder, which engine is characterized in that said cylinder is formed with an auxiliary intake passage which communicates with the intake passage, and opens in the piston sliding wall so that it is circumferentially spaced from the opening of said intake passage. As a result, the effective area of the intake ports can be increased to improve the engine performance. The drawback such as the generation of rattling noises or the power loss due to the tilting phenomena of the piston can be eliminated.

This invention is not to be limited by the embodiments shown in the drawings and described in the description, which are given by way of example and not of limitation, but only in accordance with the scope of the appended claims.

I claim:

1. In a two-cycle engine having a cylinder bounded by a piston sliding wall, an intake passage, an exhaust passage, a scavenging passage, said passages opening into said cylinder through said piston sliding wall whereby to form a main intake port, an exhaust port, and a scavenging port, the improvement comprising: an auxiliary intake port opening through said piston sliding wall and communicating with said intake passage, said auxiliary intake port being circumferentially spaced from said main intake port and said main intake port having a substantially greater circumferential extent than said auxiliary intake port, and said intake passage and said scavenging passage being independent from one another and non-communicating with one another, each opening into independent respective main and auxiliary intake ports and scavenging port.

2. Apparatus according to claim 1 in which there are two of said auxiliary intake ports, one spaced on each side of said main intake port.

3. Apparatus according to claim 1 in which said auxiliary intake port is substantially axially co-extensive with said main intake port, whereby to form between it and said main intake port an axially-extending guide surface on said piston sliding wall.

4. Apparatus according to claim 3 in which there are two of said auxiliary intake ports and two of said guide surfaces, one disposed on each side of said main intake port.

* * * * *